US011061341B2

(12) United States Patent
Nishi et al.

(10) Patent No.: US 11,061,341 B2
(45) Date of Patent: Jul. 13, 2021

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Masashi Nishi, Susono (JP); Takashi Anezaki, Hiratsuka (JP); Taichi Sato, Numazu (JP); Atsushi Fujii, Yokohama (JP); Kunihiko Sekido, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/521,450

(22) Filed: Jul. 24, 2019

(65) Prior Publication Data

US 2020/0041918 A1 Feb. 6, 2020

(51) Int. Cl.

| | |
|---|---|
| ***G03G 5/14*** | (2006.01) |
| ***G03G 5/043*** | (2006.01) |
| ***G03G 5/147*** | (2006.01) |
| ***G03G 5/08*** | (2006.01) |
| ***G03G 5/06*** | (2006.01) |
| ***G03G 5/07*** | (2006.01) |

(52) U.S. Cl.

CPC ..... *G03G 5/0436* (2013.01); *G03G 5/0651* (2013.01); *G03G 5/071* (2013.01); *G03G 5/08* (2013.01); *G03G 5/142* (2013.01); *G03G 5/144* (2013.01); *G03G 5/14786* (2013.01)

(58) Field of Classification Search

CPC .. G03G 5/0436; G03G 5/14786; G03G 5/142; G03G 5/08; G03G 5/071; G03G 5/0655; G03G 5/0661; G03G 5/0651; G03G 5/14795; G03G 5/14791; G03G 5/104

See application file for complete search history.

(56) References Cited

U.S. PATENT DOCUMENTS

| | | | | |
|---|---|---|---|---|
| 7,897,312 | B2 * | 3/2011 | Itami | G03G 5/047 399/159 |
| 2015/0099218 | A1 * | 4/2015 | Murakami | G03G 5/071 430/65 |
| 2015/0185636 | A1 * | 7/2015 | Sekiya | G03G 5/142 430/56 |
| 2015/0212437 | A1 * | 7/2015 | Shida | G03G 5/00 430/56 |
| 2018/0341190 | A1 * | 11/2018 | Nishi | G03G 5/142 |

FOREIGN PATENT DOCUMENTS

| | | | |
|---|---|---|---|
| JP | 3717320 | B2 | 11/2005 |
| JP | 2014-215477 | A | 11/2014 |
| JP | 2017-203821 | A | 11/2017 |

* cited by examiner

*Primary Examiner* — Christopher D Rodee

(74) *Attorney, Agent, or Firm* — Canon U.S.A., Inc., IP Division

(57) ABSTRACT

An electrophotographic photosensitive member includes, in sequence, a support, a conductive layer, an undercoat layer, a charge generation layer, and a charge transport layer. The conductive layer is a cured film, and the cured film contains titanium oxide particles doped with niobium. The undercoat layer contains a cured product of a composition that contains an electron transport material having a polymerizable functional group and a resin functionalized with a carboxylic acid derivative.

7 Claims, 3 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present disclosure relates to an electrophotographic photosensitive member, a process cartridge including an electrophotographic photosensitive member, and an electrophotographic apparatus including an electrophotographic photosensitive member.

Description of the Related Art

Currently, mainstream electrophotographic photosensitive members mounted on process cartridges and electrophotographic apparatuses are those containing organic photoconductive substances (organic electrophotographic photosensitive members, hereinafter also referred to as "photosensitive members"). Electrophotographic photosensitive members containing organic photoconductive substances have advantages such as nonpolluting characteristics, high productivity, and ease of material design.

An electrophotographic photosensitive member typically includes a support and a photosensitive layer formed on the support. The photosensitive layer typically has a multilayer structure in which a charge generation layer and a charge transport layer are stacked in this order from the support side. Furthermore, an intermediate layer is often disposed between the support and the photosensitive layer in order to reduce charge injection from the support side to the photosensitive layer side to thereby prevent the occurrence of image failures such as black spots. An undercoat layer such as a conductive layer may be disposed between the support and the intermediate layer.

Recent charge generation materials have higher sensitivity and generate increased amounts of charge. This is disadvantageous in that generated charges tend to remain in the charge generation layer.

One known technique for preventing charges from remaining in the charge generation layer is to incorporate an electron transport material into the intermediate layer to thereby allow electrons to smoothly migrate from the charge generation layer side to the support side. Another known technique is to use, as the intermediate layer, a cured product that can hardly be dissolved by a charge generation layer coating liquid so that the electron transport material is not eluted during the formation of the charge generation layer on the intermediate layer.

However, an intermediate layer formed of such a cured product may have low adhesion to other layers, and techniques for achieving improved intermediate layers having improved adhesion have been under development.

Japanese Patent Laid-Open No. 2014-215477 discloses a technique in which an electron transport material having a particular structure is incorporated into an intermediate layer. Japanese Patent Laid-Open No. 2017-203821 discloses a technique in which hollow particles and rubber particles are incorporated.

SUMMARY OF THE INVENTION

One aspect of the present disclosure is directed to providing an electrophotographic photosensitive member having improved resistance to external stress.

Another aspect of the present disclosure is directed to providing a process cartridge conducive to stable formation of high-quality electrophotographic images.

Still another aspect of the present disclosure is directed to providing an electrophotographic apparatus that enables high-quality electrophotographic images to be stably formed.

According to one aspect of the present disclosure, there is provided an electrophotographic photosensitive member including, in sequence, a support, a conductive layer, an undercoat layer, a charge generation layer, and a charge transport layer. The conductive layer is a cured film, and the cured film contains titanium oxide particles doped with niobium. The undercoat layer contains a cured product of a composition that contains an electron transport material having a polymerizable functional group and a resin functionalized with a carboxylic acid derivative.

According to another aspect of the present disclosure, there is provided a process cartridge that integrally supports the above electrophotographic photosensitive member and at least one device selected from the group consisting of a charging device, a developing device, a transfer device, and a cleaning device and that is attachable to and detachable from a main body of an electrophotographic apparatus.

According to still another aspect of the present disclosure, there is provided an electrophotographic apparatus including the above electrophotographic photosensitive member, a charging device, an exposure device, a developing device, and a transfer device.

Further features of the present disclosure will become apparent from the following description of exemplary embodiments with reference to the attached drawings.

DESCRIPTION OF THE EMBODIMENTS

Figure 1:
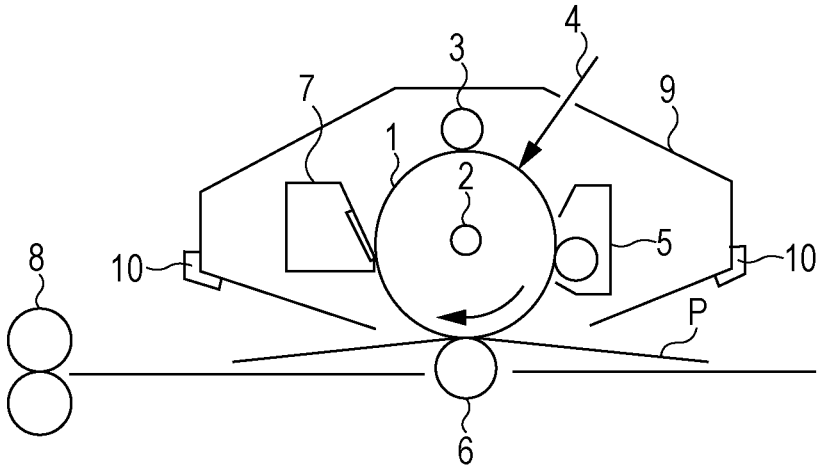
FIG. 1 illustrates a schematic structure of an exemplary electrophotographic apparatus including a process cartridge including an electrophotographic photosensitive member.

In recent years, there has been an increasing demand for image output at higher speed, and under these circumstances, the mechanical stress on photosensitive members have been increasing. From the standpoint of usability, there has been a demand for photosensitive members having high strength so as not to readily suffer damage when they hit somewhere, for example, during cartridge replacement.

The present inventors have conducted studies and found that the techniques disclosed in Japanese Patent Laid-Open Nos. 2014-215477 and 2017-203821 still have room for improvement in the adhesion of the intermediate layer to other layers and the resistance to external stress.

In an electrophotographic photosensitive member of the present disclosure, a conductive layer is a cured film; the cured film contains titanium oxide particles doped with niobium (hereinafter also referred to as "niobium-doped titanium oxide particles"); and an undercoat layer contains a cured product of a composition that contains an electron transport material having a polymerizable functional group and a resin functionalized with a carboxylic acid derivative.

The present inventors presume that the undercoat layer having the above-described composition reduces worsening of ghosts and also improves resistance to external stress because of the following reason.

Conductive materials such as metal oxides are easily influenced by environmental conditions such as temperature and humidity; thus, cured films are often used as conductive layers to reduce such influences. However, when an undercoat layer disposed directly on a conductive layer contains a cured product, the interaction between the layers is weak, and the layers poorly adhere to each other. The present inventors have conducted studies and found that using titanium oxide particles as conductive materials of a conductive layer and incorporating a resin functionalized with a carboxylic acid derivative into an undercoat layer improves the interaction between the conductive layer and the undercoat layer and improves resistance to external stress.

It is widely known that the interaction between titanium oxide and carboxylic acid derivatives are strong, but its mechanism has not been fully elucidated. It is generally believed that metal oxides such as titanium oxide particles have, on their solid surface, sites where charges are concentrated (polarity sites), and carboxylic acid derivatives are adsorbed to the sites. However, when titanium oxide particles are used as conductive materials, a ghost phenomenon worsens through repeated use. This is probably because titanium oxide particles have high electrical resistance and thus charges do not flow smoothly.

Thus, the present inventors have conducted further studies and found that using titanium oxide particles doped with niobium can reduce worsening of ghosts and improve resistance to external stress. The present inventors believe that this is due to the following reason. Niobium doping can reduce electrical resistance of titanium oxide particles. In addition, niobium-doped titanium oxide particles have more uneven surface structures than undoped titanium oxide particles, and thus have more polarity sites and more strongly interact with carboxylic acid derivatives.

Electrophotographic Photosensitive Member

Figure 4:
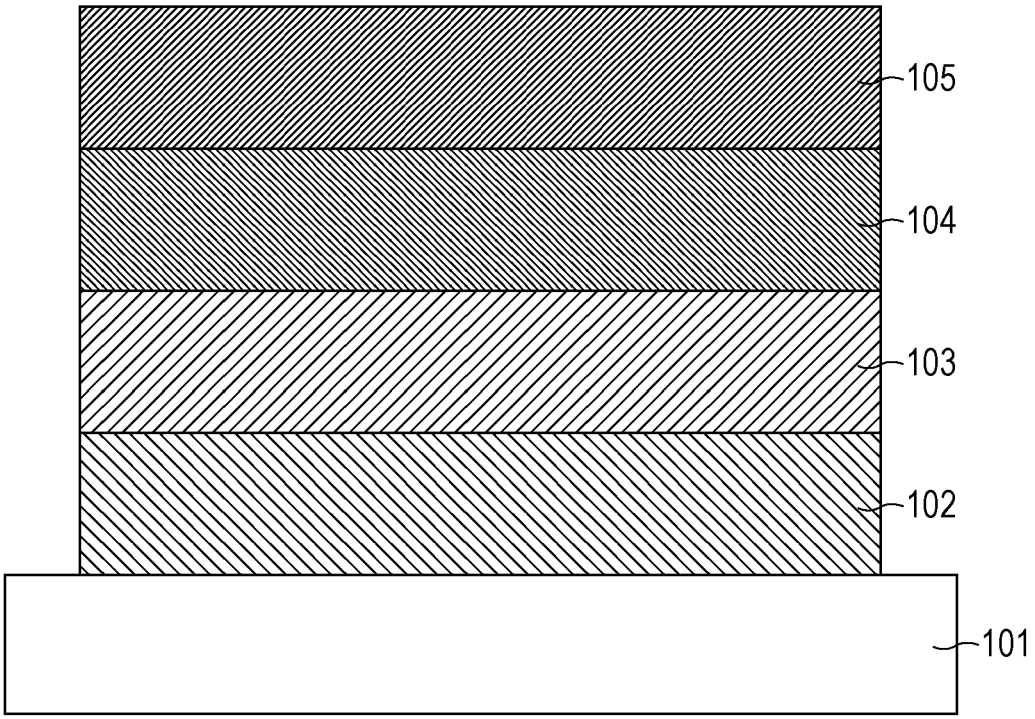
FIG. 4 illustrates an exemplary layer structure of an electrophotographic photosensitive member.

FIG. 4 illustrates an exemplary layer structure of an electrophotographic photosensitive member. In FIG. 4, a conductive layer 102 is disposed on a support 101, an undercoat layer 103 on the conductive layer 102, a charge generation layer 104 on the undercoat layer 103, and a charge transport layer 105 on the charge generation layer 104. In other words, the electrophotographic photosensitive member includes, in sequence, the support 101, the conductive layer 102, the undercoat layer 103, the charge generation layer 104, and the charge transport layer 105. Although electrophotographic photosensitive members having cylindrical shapes are commonly used, electrophotographic photosensitive members having belt shapes, sheet shapes, and other shapes may also be used.

Support

The support may be a support having conductivity (conductive support). For example, a support made of a metal such as aluminum, nickel, copper, gold, or iron or an alloy thereof can be used. Alternatively, a support obtained by forming a thin film made of a conductive material such as a metal or a metal oxide on an insulating support may be used as the conductive support. For example, a support obtained by forming a thin film made of a metal such as aluminum, silver, or gold on an insulating support made of a polyester resin, a polycarbonate resin, a polyimide resin, or glass, or a support obtained by forming a thin film made of a conductive material such as indium oxide or tin oxide on such an insulating support may be used. The surface of the support may be subjected to electrochemical treatment such as anodic oxidation, wet honing treatment, blasting treatment, or cutting treatment in order to improve electrical properties and reduce interference fringes.

Conductive Layer

The conductive layer of the electrophotographic photosensitive member of the present disclosure is a cured film and contains titanium oxide particles doped with niobium. The conductive layer may further contain, for example, a masking agent such as silicone oil or resin particles.

The thickness of the conductive layer is preferably 0.2 μm or more and 40 μm or less, more preferably 1 μm or more and 35 μm or less, still more preferably 5 μm or more and 30 μm or less.

The conductive layer may be formed, for example, by the following method: a wet coating of a conductive layer coating liquid obtained by dispersing titanium oxide particles doped with niobium in a polymerizable resin is formed on the support, and the wet coating is dried. The resin is polymerized during the drying of the wet coating of the conductive layer coating liquid. This polymerization reaction (curing reaction) is promoted by applying energy such as heat or light.

Examples of solvents used for the conductive layer coating liquid include ether solvents, alcohol solvents, ketone solvents, and aromatic hydrocarbon solvents. The conductive particles may be dispersed in the conductive layer coating liquid by using, for example, a paint shaker, a sand mill, a ball mill, or a liquid-collision-type high-speed disperser.

Examples of polymerizable resins include acrylic resins, epoxy resins, melamine resins, urethane resins, and phenol resins. Phenol resins are preferred. In particular, at least one phenol resin selected from the group consisting of cresol-modified phenol resins, epoxy-modified phenol resins, and alkyl-modified phenol resins may be contained.

In addition, another resin may be contained. The other resin may be, for example, a polyester resin, a polycarbonate resin, a polyvinyl butyral resin, a polyrotaxane resin, or an acrylic acid ester resin. The conductive layer may further contain a resin having at least one of a hydroxy group and a carboxyl group.

Titanium Oxide Particles Doped with Niobium

The niobium-doped titanium oxide particles may have various shapes such as spherical, polyhedral, ellipsoidal, flaky, and spicular shapes. To reduce image failures such as black spots, the niobium-doped titanium oxide particles are preferably spherical, polyhedral, or ellipsoidal. In the present disclosure, the niobium-doped titanium oxide particles more preferably have a spherical shape or a polyhedral shape close to spherical.

The niobium-doped titanium oxide particles are preferably particles of anatase-type or rutile-type titanium oxide, more preferably particles of anatase-type titanium oxide. Using anatase-type titanium oxide reduces the likelihood of worsening of ghosts. In the present disclosure, the titanium oxide particles doped with niobium are particularly preferably particles obtained by coating anatase-type titanium oxide particles serving as cores with titanium oxide doped with niobium. The niobium-doped titanium oxide particles may be surface-treated, for example, with a silane coupling agent.

The average primary particle size of the niobium-doped titanium oxide particles is preferably 50 nm or more and 500 nm or less, more preferably 100 nm or more and 400 nm or less. Niobium-doped titanium oxide particles having an average primary particle size of 50 nm or more are less likely to reaggregate after the conductive layer coating liquid is prepared. Reaggregation of the titanium oxide particles disadvantageously reduces the stability of the conductive layer coating liquid or results in a conductive layer whose surface is prone to cracking. Niobium-doped titanium oxide particles having an average primary particle size of 500 nm or less tend to provide a conductive layer whose surface is unrough. A conductive layer having a rough surface disadvantageously increases the likelihood of local charge injection into a photosensitive layer, leading to an output image with conspicuous black spots in a white ground.

The doping amount of niobium is preferably 0.5 mass % or more and 10.0 mass % or less, more preferably 1.0 mass % or more and 7.0 mass % or less, based on the mass of the doped titanium oxide particles. A doping amount of less than 0.5 mass % may lead to an insufficient ghost-reducing effect, and a doping amount of more than 10.0 mass % may increase the likelihood of leakage.

The content of the titanium oxide particles doped with niobium is preferably 20 vol % or more and 50 vol % or less, more preferably 30 vol % or more and 45 vol % or less, based on the total mass of the conductive layer. If the content is less than 20 vol %, the distance between the titanium oxide particles tends to be large, and the conductive layer tends to have a high volume resistivity, which may impede the flow of charges during image formation, leading to an insufficient ghost-reducing effect.

In the present disclosure, the conductive layer may further contain another type of conductive particles. Examples of materials of the other type of conductive particles include metal oxides, metals, and carbon black. Examples of metal oxides include zinc oxide, aluminum oxide, indium oxide, silicon oxide, zirconium oxide, tin oxide, titanium oxide, magnesium oxide, antimony oxide, and bismuth oxide. Examples of metals include aluminum, nickel, iron, nichrome, copper, zinc, and silver. The other type of conductive particles may be made of a metal oxide surface-treated with, for example, a silane coupling agent or a metal oxide doped with an element such as phosphorus or aluminum or an oxide thereof. The other type of conductive particles may have a layered structure including core particles and a coating layer covering the core particles. The core particles may be made of, for example, titanium oxide, barium sulfate, or zinc oxide. The coating layer may be made of, for example, a metal oxide such as tin oxide.

When metal oxide particles are used as the other type of conductive particles, their volume-average particle size is preferably 1 nm or more and 500 nm or less, more preferably 3 nm or more and 400 nm or less.

Undercoat Layer

The undercoat layer of the electrophotographic photosensitive member of the present disclosure contains a cured product of a composition that contains an electron transport material having a polymerizable functional group and a resin functionalized with a carboxylic acid derivative. The composition may further contain a biuret-type isocyanate compound serving as a crosslinking agent, that is, the undercoat layer may contain a cured product of a composition that contains an electron transport material having a polymerizable functional group, a resin functionalized with a carboxylic acid derivative, and a biuret-type isocyanate compound.

The thickness of the undercoat layer is preferably 0.2 μm or more and 3.0 μm or less, more preferably 0.4 μm or more and 1.5 μm or less.

The undercoat layer can be formed by forming a wet coating of an undercoat layer coating liquid containing the above composition and drying the wet coating. The composition is polymerized during the drying of the wet coating of the undercoat layer coating liquid. This polymerization reaction (curing reaction) is promoted by applying energy such as heat or light. Examples of solvents used for the undercoat layer coating liquid include alcohol solvents, sulfoxide solvents, ketone solvents, ether solvents, ester solvents, and aromatic hydrocarbon solvents.

Electron Transport Material Having Polymerizable Functional Group

The polymerizable functional group of the electron transport material having a polymerizable functional group may be at least one group selected from the group consisting of a hydroxy group, a thiol group, an amino group, and a carboxyl group.

Examples of the electron transport material include ketone compounds, quinone compounds, imide compounds, and cyclopentadienylidene compounds. Specific examples include compounds represented by formulae (A1) to (A11).

(A1)

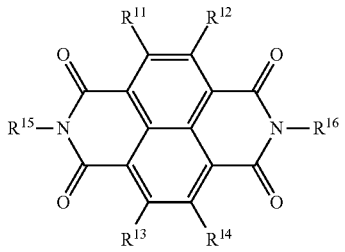

(A2)

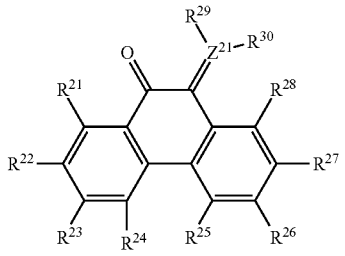

(A3)

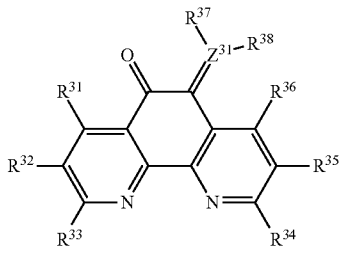

(A4)

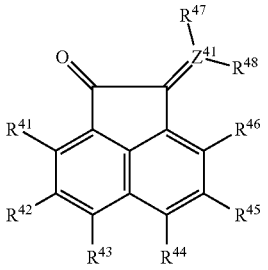

-continued (A5)

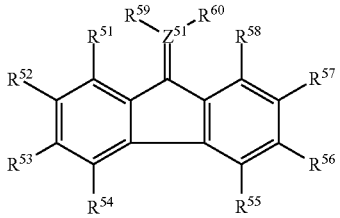

(A6)

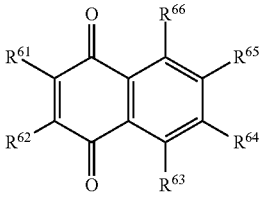

(A7)

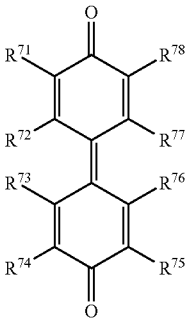

(A8)

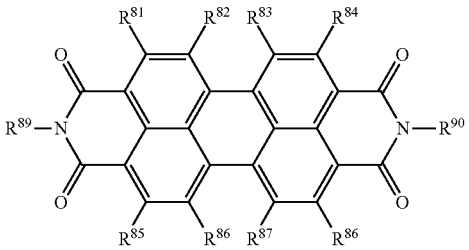

(A9)

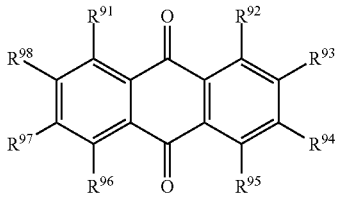

(A10)

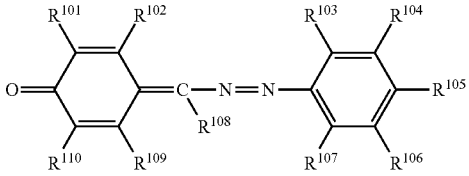

-continued (A11)

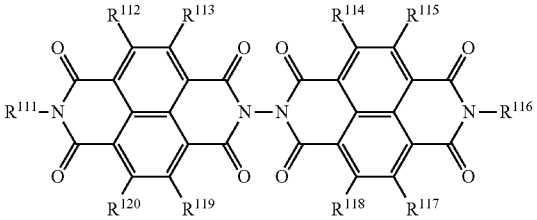

In formulae (A1) to (A11), $R^{11}$ to $R^{16}$, $R^{21}$ to $R^{30}$, $R^{31}$ to $R^{38}$, $R^{41}$ to $R^{48}$, $R^{51}$ to $R^{60}$, $R^{61}$ to $R^{66}$, $R^{71}$ to $R^{78}$, $R^{81}$ to $R^{90}$, $R^{91}$ to $R^{98}$, $R^{101}$ to $R^{110}$, and $R^{111}$ to $R^{120}$ each independently represent a monovalent group represented by formula (I) below, a hydrogen atom, a cyano group, a nitro group, a halogen atom, an alkoxycarbonyl group, a substituted or unsubstituted alkyl group, a substituted or unsubstituted aryl group, or a substituted or unsubstituted heterocyclic group. One carbon atom in the main chain of the alkyl group may be replaced with O, S, NH, or $NR^{121}$ ($R^{121}$ is an alkyl group). At least one of $R^{11}$ to $R^{16}$, at least one of $R^{21}$ to $R^{30}$, at least one of $R^{31}$ to $R^{38}$, at least one of $R^{41}$ to $R^{48}$, at least one of $R^{51}$ to $R^{60}$, at least one of $R^{61}$ to $R^{66}$, at least one of $R^{71}$ to $R^{78}$, at least one of $R^{81}$ to $R^{90}$, at least one of $R^{91}$ to $R^{98}$, at least one of $R^{101}$ to $R^{110}$, and at least one of $R^{111}$ to $R^{120}$ each have the monovalent group represented by formula (I).

The substituent of the substituted alkyl group is an alkyl group, an aryl group, a halogen atom, or an alkoxycarbonyl group. The substituent of the substituted aryl group and the substituent of the substituted heterocyclic group are each a halogen atom, a nitro group, a cyano group, an alkyl group, a halogen-substituted alkyl group, or an alkoxy group. $Z^{21}$, $Z^{31}$, $Z^{41}$ and $Z^{51}$ each independently represent a carbon atom, a nitrogen atom, or an oxygen atom. When $Z^{21}$ is an oxygen atom, $R^{29}$ and $R^{30}$ are not present, and when $Z^{21}$ is a nitrogen atom, $R^{30}$ is not present. When $Z^{31}$ is an oxygen atom, $R^{37}$ and $R^{38}$ are not present, and when $Z^{31}$ is a nitrogen atom, $R^{38}$ is not present. When $Z^{41}$ is an oxygen atom, $R^{47}$ and $R^{48}$ are not present, and when $Z^{41}$ is a nitrogen atom, $R^{48}$ is not present. When $Z^{51}$ is an oxygen atom, $R^{59}$ and $R^{60}$ are not present, and when $Z^{51}$ is a nitrogen atom, $R^{60}$ is not present.

$$-(\alpha)_l-(\beta)_m-\gamma \qquad \text{(I)}$$

In formula (I), at least one of α, β, and γ is a group having a polymerizable functional group, and the polymerizable functional group is at least one group selected from the group consisting of a hydroxy group, a thiol group, an amino group, and a carboxyl group. l and m are each independently 0 or 1, and the sum of l and m is 0 to 2.

α represents an alkylene group having 1 to 6 main-chain carbon atoms, an alkylene group having 1 to 6 main-chain carbon atoms and substituted with an alkyl group having 1 to 6 carbon atoms, an alkylene group having 1 to 6 main-chain carbon atoms and substituted with a benzyl group, an alkylene group having 1 to 6 main-chain carbon atoms and substituted with an alkoxycarbonyl group, or an alkylene group having 1 to 6 main-chain carbon atoms and substituted with a phenyl group. These groups each may have a polymerizable functional group. One carbon atom in the main chain of the alkylene group may be replaced with O, S, or $NR^{122}$ (where $R^{122}$ represents a hydrogen atom or an alkyl group).

β represents a phenylene group, a phenylene group substituted with an alkyl group having 1 to 6 carbon atoms, a nitro-substituted phenylene group, a halogen-substituted phenylene group, or an alkoxy-substituted phenylene group. These groups may each have a polymerizable functional group.

γ represents a hydrogen atom, an alkyl group having 1 to 6 main-chain carbon atoms, or an alkyl group having 1 to 6 main-chain carbon atoms and substituted with an alkyl group having 1 to 6 carbon atoms. These groups may each have a polymerizable functional group. One carbon atom in the main chain of the alkyl group may be replaced with O, S, or $NR^{123}$ (where $R^{123}$ represents a hydrogen atom or an alkyl group).

Derivatives (derivatives of the electron transport material) having any of the structures of formulae (A2) to (A6) and (A9) are available from Tokyo Chemical Industry Co., Ltd., Sigma-Aldrich Japan K.K., or Johnson Matthey Japan G.K. The derivative having the structure of formula (A1) can be synthesized by a reaction between naphthalenetetracarboxylic dianhydride available from Tokyo Chemical Industry Co., Ltd. or Johnson Matthey Japan G.K. and a monoamine derivative. The derivative having the structure of formula (A7) can be synthesized using, as a raw material, a phenol derivative available from Tokyo Chemical Industry Co., Ltd. or Sigma-Aldrich Japan K.K. The derivative having the structure of formula (A8) can be synthesized by a reaction between perylenetetracarboxylic dianhydride available from Tokyo Chemical Industry Co., Ltd. or Sigma-Aldrich Japan K.K. and a monoamine derivative. The derivative having the structure of formula (A10) can be synthesized by oxidizing a phenol derivative having a hydrazone structure in an organic solvent with an appropriate oxidizing agent such as potassium permanganate using, for example, a known synthesis method described in Japanese Patent No. 3717320. The derivative having the structure of formula (A11) can be synthesized by a reaction of naphthalenetetracarboxylic dianhydride available from Tokyo Chemical Industry Co., Ltd., Sigma-Aldrich Japan K.K., or Johnson Matthey Japan G.K., a monoamine derivative, and hydrazine.

A compound represented by any of formulae (A1) to (A11) has a polymerizable functional group (a hydroxy group, a thiol group, an amino group, or a carboxyl group) polymerizable with a crosslinking agent. The compound represented by any of formulae (A1) to (A11) may be synthesized by introducing a polymerizable functional group into a derivative having any of the structures of formulae (A1) to (A11), specifically as follows.

For example, a derivative having any of the structures of formulae (A1) to (A11) is synthesized, and a polymerizable functional group is then directly introduced into the derivative. Alternatively, a structure having a polymerizable functional group or a functional group that can serve as a precursor of the polymerizable functional group is introduced into the derivative. The latter method may be performed, for example, as follows: using a halide of a derivative having any of the structures of formulae (A1) to (A11) as a starting material, an aryl group having a functional group is introduced, for example, by a cross-coupling reaction using a palladium catalyst and a base; using a halide of a derivative having any of the structures of formulae (A1) to (A11) as a starting material, an alkyl group having a functional group is introduced by a cross-coupling reaction using an $FeCl_3$ catalyst and a base; or using a halide of a derivative having any of the structures of formulae (A1) to (A11) as a starting material, a hydroxyalkyl group or a carboxyl group is introduced by lithiating the halide and then allowing an epoxy compound or $CO_2$ to act on the lithiated halide.

More preferably, the electron transport material is a compound represented by formula (A1).

(A1)

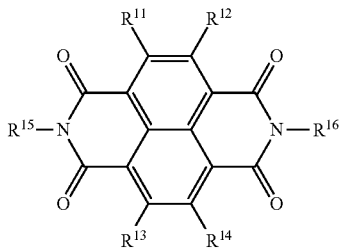

In formula (A1), $R^{15}$ and $R^{16}$ are each independently a substituted or unsubstituted alkyl group having 2 to 6 carbon atoms, a group derived from a substituted or unsubstituted alkyl group having 3 to 6 main-chain carbon atoms by replacing at least one $CH_2$ in the main chain with an oxygen atom, a group derived from a substituted or unsubstituted alkyl group having 3 to 6 main-chain carbon atoms by replacing at least one $CH_2$ in the main chain with $NR^{124}$, a group derived from a substituted or unsubstituted alkyl group having 3 to 6 main-chain carbon atoms by replacing at least one $C_2H_4$ in the main chain with COO, or a substituted aryl group. $R^{124}$ represents a hydrogen atom or an alkyl group having 1 to 4 carbon atoms. The substituents of the substituted alkyl group, the group derived from a substituted alkyl group by replacing at least one $CH_2$ in the main chain with an oxygen atom, the group derived from a substituted alkyl group by replacing at least one $CH_2$ in the main chain with $NR^{124}$, and the group derived from a substituted alkyl group by replacing at least one $C_2H_4$ in the main chain with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group. The substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group and includes at least one hydroxy group or carboxyl group. $R^{11}$ to $R^{14}$ each independently represent a hydrogen atom, a halogen atom, a cyano group, a nitro group, a substituted or unsubstituted alkyl group having 1 to 6 carbon atoms, or a substituted or unsubstituted aryl group.

From the viewpoint of ease of film formation and electrical properties, the content of the electron transport material is preferably 40 mass % or more and 60 mass % or less, more preferably 45 mass % or more and 55 mass % or less, based on the total amount of the undercoat layer.

More specific examples of electron transport materials are shown below, but the present disclosure is not limited to these examples. The electron transport materials may be used in combination.

| Exemplary compound | Structure |
|---|---|
| A1-1 | 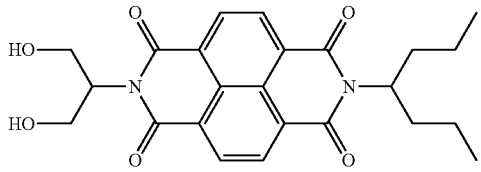 |
| A1-2 | 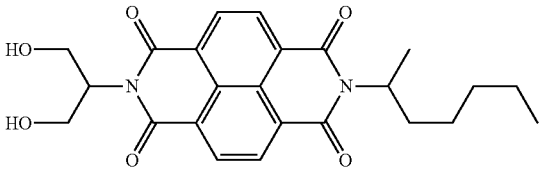 |
| A1-3 | 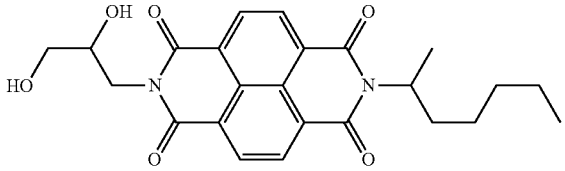 |
| A1-4 | 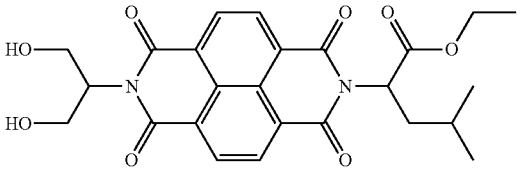 |
| A1-5 | 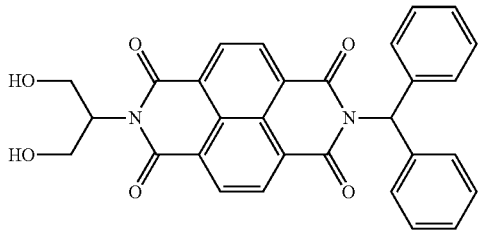 |
| A1-6 | 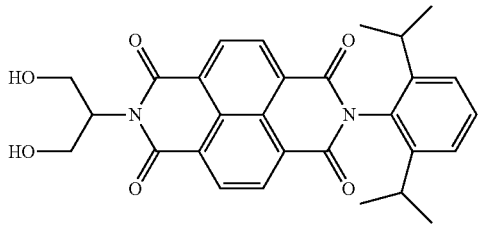 |
| A1-7 | 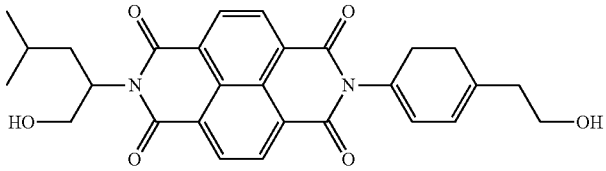 |
| A1-8 | 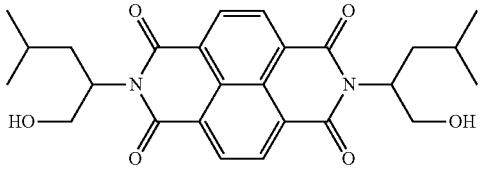 |

-continued

| Exemplary compound | Structure |
|---|---|
| A1-9 | 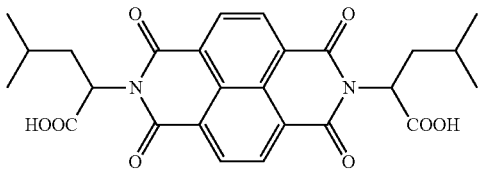 |
| A1-10 | 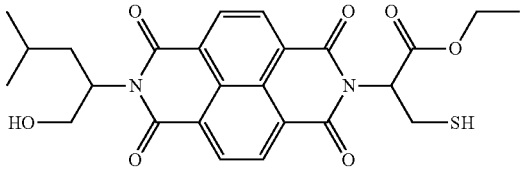 |

Resin Functionalized with Carboxylic Acid Derivative

The carboxylic acid derivative is at least one group/structure selected from the group consisting of a carboxyl group, an alkoxycarbonyl group, and a carboxylic acid anhydride structure. Furthermore, the resin may be a resin having a structure represented by formula (B1) and a structure represented by formula (B2).

(B1)

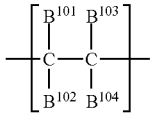

In formula (B1), $B^{101}$ to $B^{104}$ are each independently at least one member selected from the group consisting of a hydrogen atom, a methyl group, and a substituted or unsubstituted phenyl group, and at least one of $B^{101}$ to $B^{104}$ is a substituted or unsubstituted phenyl group.

(B2)

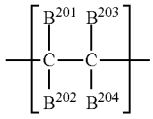

In formula (B2), $B^{201}$ to $B^{204}$ are each independently at least one member selected from the group consisting of a hydrogen atom, a methyl group, a carboxyl group, and an alkoxycarbonyl group, and at least one of $B^{201}$ to $B^{204}$ is a carboxyl group or an alkoxycarbonyl group; or $B^{201}$ and $B^{203}$ are each independently a hydrogen atom or a methyl group, and $B^{202}$ and $B^{204}$ are linked together through —C(=O)OC(=O)—. More specific examples of the resin functionalized with a carboxylic acid derivative include acrylic acid resins, acrylic acid ester resins, styrene-maleic acid copolymer resins, styrene-acrylic acid copolymer resins, and styrene-acrylic acid ester copolymer resins. These resins may be used in combination. Examples of such resins that are commercially available include AQUALIC manufactured by Nippon Shokubai Co., Ltd.; FINELEX SG2000 manufactured by Namariichi Co., Ltd.; ARUFON UC-3900, UC-3920, UF-5022, and UF-5041 manufactured by Toagosei Co., Ltd.; X-200, X-228, YS-1274, and RS-1191 manufactured by Seiko PMC Corporation; and SMA1000, SMA2000, SMA3000, SMA1440, and SMA2625 manufactured by Cray Valley HSC.

To achieve both electrical properties and strength, the content of the resin functionalized with a carboxylic acid derivative in the composition is preferably 0.5 mass % or more and 10.0 mass % or less, more preferably 1.0 mass % or more and 5.0 mass % or less.

In addition, the acid value of the resin functionalized with a carboxylic acid derivative is preferably 150 mgKOH/g or more, more preferably 200 mgKOH/g or more.

Crosslinking Agent

The composition may further contain a crosslinking agent. The crosslinking agent may be a compound that polymerizes (cures) or crosslinks with the electron transport material or the resin. Specific examples include isocyanate compounds. The isocyanate compounds may be used in combination.

The isocyanate compound may be an isocyanate compound having three or more isocyanate or blocked isocyanate groups. Examples include triisocyanatobenzene, triisocyanatomethylbenzene, triphenylmethane triisocyanate, lysine triisocyanate; and isocyanurate-modified diisocyanates, biuret-modified diisocyanates, allophanate-modified diisocyanates, trimethylolpropane adducts of diisocyanates, and pentaerythritol adducts of diisocyanates, such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl-2,6-diisocyanato hexanoate, and norbornane diisocyanate.

Of these, biuret-modified diisocyanates (biuret-type isocyanate compounds) are more preferred. Biuret-type isocyanate compounds have relatively flexible structures and thus provide cured products with high flexibility, leading to improved adhesion due to stress relaxation. Biuret-type isocyanate compounds having a structure of formula (1) are more preferred.

(1)

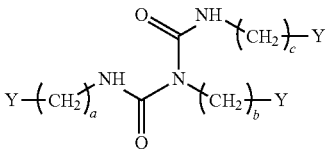

In formula (1), Y represents an isocyanate group or a blocked isocyanate group, and a, b, and c each independently represent an integer of 3 to 8.

The blocked isocyanate group is a group having a structure of —NHCOX$^1$ (X$^1$ is a protecting group). X$^1$ may be any protecting group that can be introduced into an isocyanate group, and examples of such protecting groups include groups represented by formulae (H1) to (H6) below.

(H1)

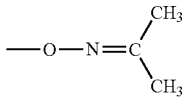

(H2)

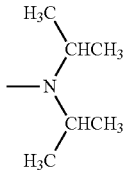

(H3)

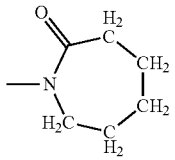

(H4)

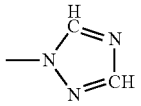

(H5)

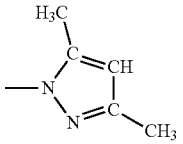

(H6)

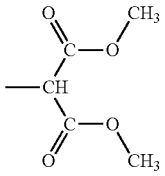

Specific examples of isocyanate compounds are shown below.

(B1)

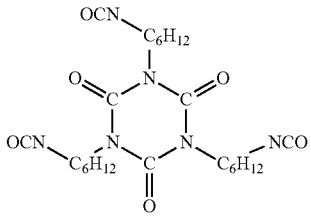

(B2)

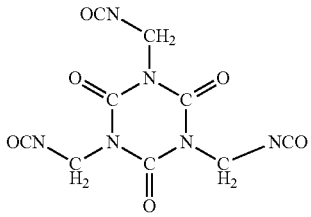

(B3)

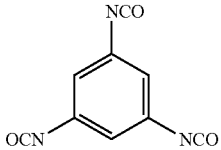

(B4)

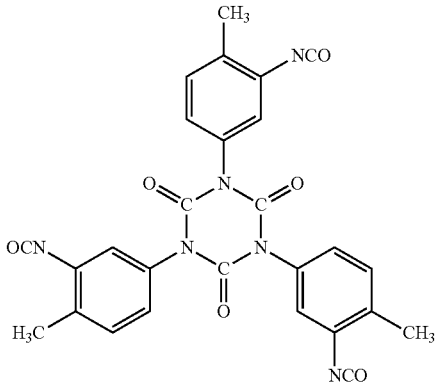

(B5)

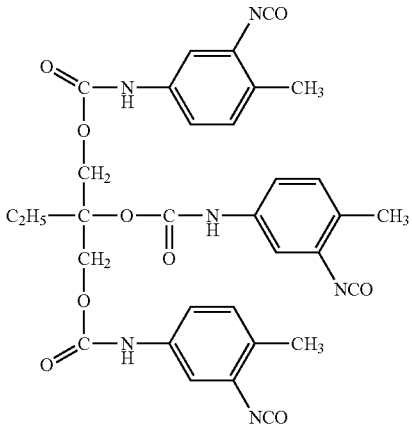

-continued
(B6)
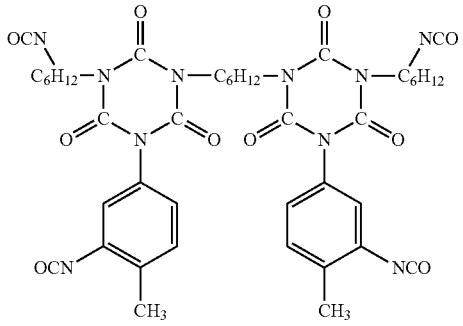
(B7)
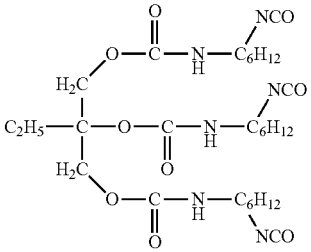
(B8)
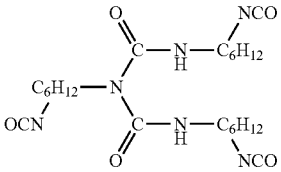
(B9)
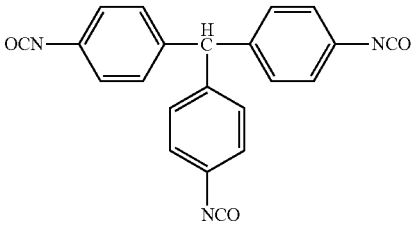
(B10)
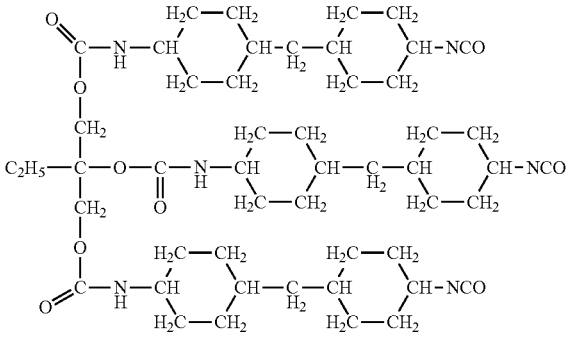
-continued
(B11)
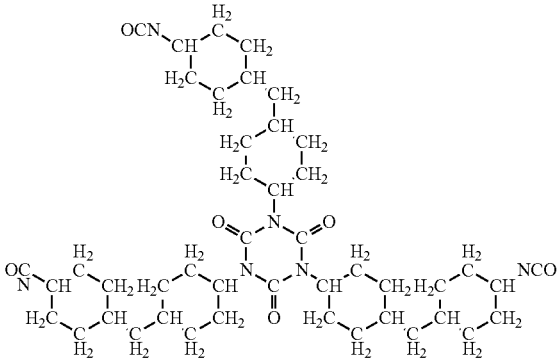
(B12)
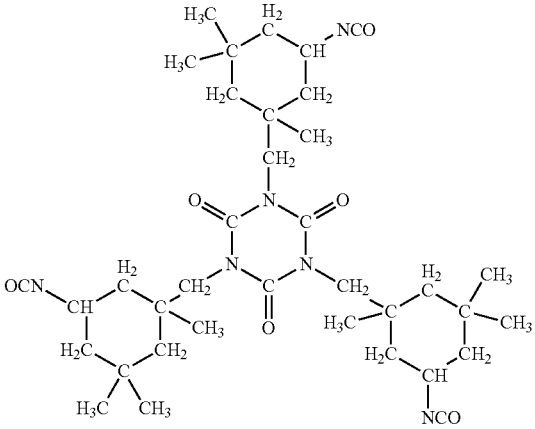
(B13)
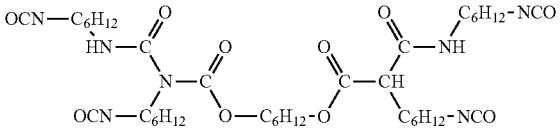
(B14)
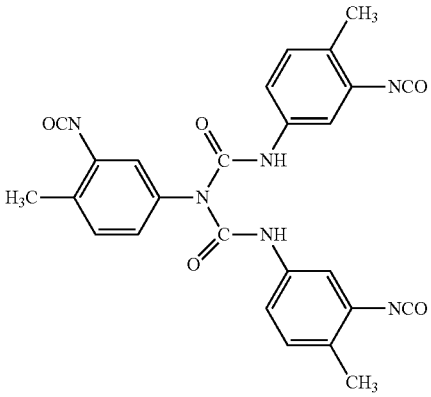

-continued (B15)

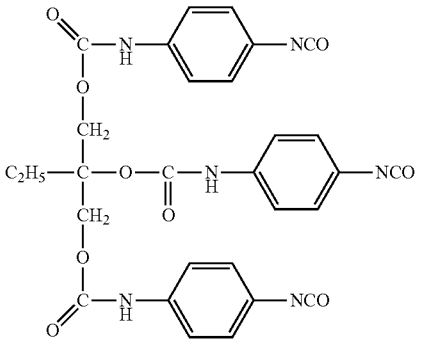

(B16)

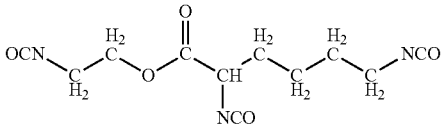

(B17)

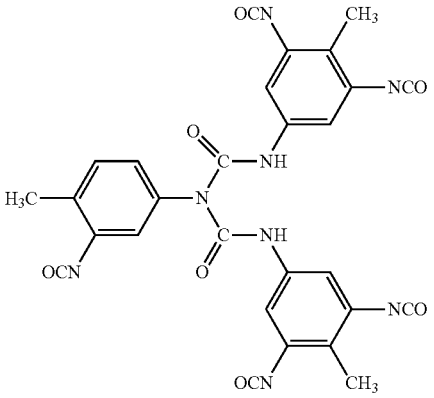

(B18)

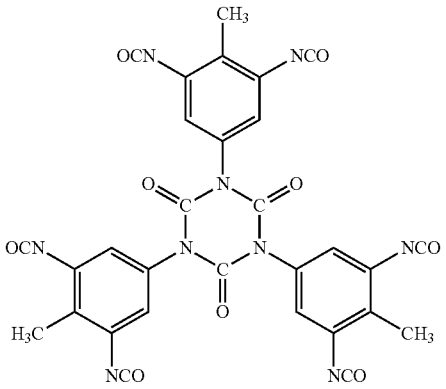

-continued (B19)

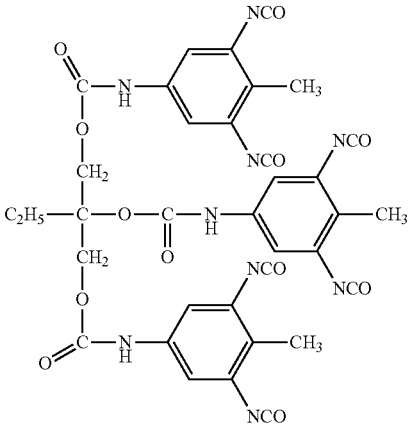

(B20)

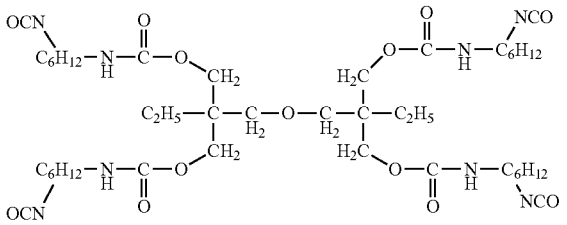

(B21)

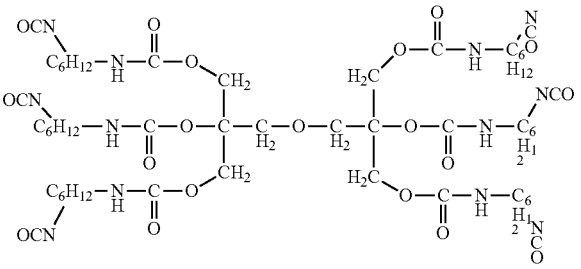

Examples of commercially available isocyanate compounds include DURANATE MF-K60B, SBA-70B, 17B-60P, SBN-70D, and SBB-70P manufactured by Asahi Kasei Corporation; and DESMODUR BL3175 and BL3475 manufactured by Sumika Covestro Urethane Co., Ltd. Of these, 17B-60P and SBB-70P are biuret-type isocyanate compounds.

Charge Generation Layer

The charge generation layer may contain a charge generation material and a binder resin.

Examples of charge generation materials include azo pigments, perylene pigments, anthraquinone derivatives, anthanthrone derivatives, dibenzpyrenequinone derivatives, pyranthrone derivatives, quinone pigments, indigoid pigments, phthalocyanine pigments, and perinone pigments. Of these, phthalocyanine pigments are preferred. Among the phthalocyanine pigments, oxytitanium phthalocyanine, chlorogallium phthalocyanine, and hydroxygallium phthalocyanine are preferred.

Examples of binder resins include polymers and copolymers of vinyl compounds such as styrene, vinyl acetate, vinyl chloride, acrylic acid esters, methacrylic acid esters, vinylidene fluoride, and trifluoroethylene; polyvinyl alcohols; polyvinyl acetals; polycarbonates; polyesters; polysulfones; polyphenylene oxides; polyurethanes; cellulose resins; phenol resins; melamine resins; silicone resins; and epoxy resins. Of these, polyesters, polycarbonates, and polyvinyl acetals are preferred.

In the charge generation layer, the ratio of charge generation materials to binder resins (charge generation material/binder resin) is preferably in the range of 10/1 to 1/10, more preferably in the range of 5/1 to 1/5.

Examples of solvents used for a charge generation layer coating liquid include alcohol solvents, ketone solvents, ether solvents, ester solvents, and aromatic hydrocarbon solvents.

The thickness of the charge generation layer is preferably 0.05 μm or more and 5 μm or less.

Charge Transport Layer

The charge transport layer may contain a charge transport material and a binder resin.

Examples of charge transport materials include hydrazone compounds, styryl compounds, benzidine compounds, butadiene compounds, enamine compounds, triarylamine compounds, and triphenylamine Polymers having groups derived from these compounds in the main chain or side chain thereof are also included.

Examples of binder resins include polyesters, polycarbonates, polymethacrylic acid esters, polyarylates, polysulfones, and polystyrenes. Of these, polycarbonates and polyarylates are preferred. These binder resins may have a weight-average molecular weight (Mw) in the range of 10,000 to 300,000.

In the charge transport layer, the ratio of charge transport materials to binder resins (charge transport material/binder resin) is preferably in the range of 10/5 to 5/10, more preferably in the range of 10/8 to 6/10.

The thickness of the charge transport layer is preferably 5 μm or more and 40 μm or less.

Examples of solvents used for a charge transport layer coating liquid include alcohol solvents, ketone solvents, ether solvents, ester solvents, and aromatic hydrocarbon solvents.

Other Layers

A protective layer containing conductive particles or a charge transport material and containing a binder resin may be disposed on the charge transport layer. The protective layer may further contain an additive such as a lubricant. The binder resin of the protective layer may be provided with conductivity or charge transportability. In such a case, the protective layer need not contain conductive particles or a charge transport material in addition to the binder resin. The binder resin of the protective layer may be a thermoplastic resin or a curable resin that can be cured by heat, light, radiation (e.g., an electron beam), or the like.

Process Cartridge and Electrophotographic Apparatus

FIG. 1 illustrates a schematic structure of an electrophotographic apparatus including a process cartridge including an electrophotographic photosensitive member. Referring to FIG. 1, a cylindrical electrophotographic photosensitive member 1 is driven in rotation about a shaft 2 at a predetermined circumferential velocity in the direction indicated by the arrow. The surface (peripheral surface) of the electrophotographic photosensitive member 1 driven in rotation is charged to a predetermined positive or negative potential by a charging device 3 (e.g., a contact charger or a noncontact charger). Subsequently, the surface is exposed with exposure light (image exposure light) 4 from an exposure device (not shown) such as a slit exposure or laser beam scanning exposure device. Thus, electrostatic latent images corresponding to desired images are successively formed on the surface of the electrophotographic photosensitive member 1.

The electrostatic latent images formed on the surface of the electrophotographic photosensitive member 1 are then developed with a toner contained in a developer in a developing device 5 to form toner images. The toner images formed and carried on the surface of the electrophotographic photosensitive member 1 are successively transferred to a transfer medium (e.g., a paper sheet) P by a transfer bias from a transfer device (e.g., a transfer roller) 6. The transfer medium P is fed from a transfer medium feeding device (not shown) to a nip (contact portion) between the electrophotographic photosensitive member 1 and the transfer device 6 in synchronization with the rotation of the electrophotographic photosensitive member 1.

The transfer medium P to which the toner images have been transferred is separated from the surface of the electrophotographic photosensitive member 1 and guided to a fixing device 8 where the toner images are fixed. Thus, the transfer medium P is output from the apparatus as an image-formed product (a print or a copy).

The surface of the electrophotographic photosensitive member 1 after the transfer of the toner images is cleaned with a cleaning device (e.g., a cleaning blade) 7 to remove the developer (residual toner) that remains after the transfer. Subsequently, the surface of the electrophotographic photosensitive member 1 is subjected to a static elimination treatment by being irradiated with pre-exposure light (not shown) from a pre-exposure device (not shown) and is then repeatedly used to form images. When the charging device 3 is a contact charging device including a charging roller as illustrated in FIG. 1, the pre-exposure is not essential.

The electrophotographic photosensitive member 1 and at least one device selected from the group consisting of the charging device 3, the developing device 5, the transfer device 6, and the cleaning device 7 may be housed in a container so as to be integrally supported as a process cartridge. The process cartridge may be configured to be attachable to and detachable from a main body of an electrophotographic apparatus. In FIG. 1, the electrophotographic photosensitive member 1, the charging device 3, the developing device 5, and the cleaning device 7 are integrally supported to form a process cartridge 9 that is attachable to and detachable from the main body of the electrophotographic apparatus through the use of a guiding device 10 such as rails of the main body of the electrophotographic apparatus.

EXAMPLES

The present disclosure will now be described in more detail with reference to examples. "Parts" in the examples means "parts by mass".

Preparation of Conductive Particles

Preparation of Niobium-Doped Titanium Oxide Particles (T1-1)

Substantially spherical anatase-type titanium dioxide particles having an average primary particle size of 150 nm and containing 0.20 wt % niobium were used as cores. The cores (100 g) were dispersed in water to provide a 1 L aqueous suspension, and the aqueous suspension was heated to 60° C. To this aqueous suspension, a titanium-niobium acid solution, which was prepared by mixing a niobium solution of 3 g of niobium pentachloride ($NbCl_5$) in 100 mL of 11.4 mol/L hydrochloric acid with 600 mL of a titanium sulfate solution containing 33.7 g of Ti, and a 10.7 mol/L sodium hydroxide solution were simultaneously added dropwise (added in parallel) over 3 hours so that the suspension had a pH of 2 to 3. After completion of the addition, the suspension was filtered, and the residue was washed and dried at 110° C. for 8 hours. The dried product was heat-treated at 800° C. for 1 hour in an air atmosphere to obtain niobium-doped titanium oxide particles (T1-1) in powder form, the particles each including the core containing titanium oxide and a coating layer containing titanium oxide doped with niobium.

Preparation of Niobium-Doped Titanium Oxide Particles (T1-2 to T1-10)

Niobium-doped titanium oxide particles (T1-2 to T1-10) in powder form having particle sizes shown in Table 1 were obtained in the same manner as (T1-1) except that the average primary particle size of the cores used and the conditions in coating were changed. The doping amount in Table 1 was determined by elementary analysis using X-ray fluorescence (XRF).

Preparation of Niobium-Doped Titanium Oxide Particles (T2-1)

Niobium sulfate (water-soluble niobium compound) was added to an aqueous titanyl sulfate solution such that the amount of niobium ions was 1.0 mass % relative to the amount of titanium (in terms of titanium dioxide). Particulate nuclei formed of titanium hydroxide were added to the resulting aqueous titanyl sulfate solution, and the resultant was hydrolyzed by heating and boiling to obtain a hydrous titanium dioxide slurry.

The hydrous titanium dioxide slurry containing niobium ions was filtered, and the residue was washed and dried at 110° C. for 8 hours. The dried product was heat-treated at 800° C. for 1 hour in an air atmosphere to obtain niobium-doped titanium oxide particles (T2-1) in powder form.

Preparation of Niobium-Doped Titanium Oxide Particles (T2-2 to T2-5)

Niobium-doped titanium oxide particles (T2-2 to T2-5) in powder form having particle sizes shown in Table 1 were obtained in the same manner as (T2-1) except that the amount of niobium sulfate added to the aqueous titanyl sulfate solution, the size of particulate nuclei added before hydrolysis, the temperature during hydrolysis, and the rate of hydrolysis were adjusted. The doping amount in Table 1 was determined by elementary analysis using X-ray fluorescence (XRF).

TABLE 1

| Niobium-doped titanium oxide particles | | |
|---|---|---|
| Particles | Average particle size (nm) | Doping amount (mass %) |
| T1-1 | 170 | 5.0 |
| T1-2 | 180 | 5.0 |
| T1-3 | 190 | 5.0 |
| T1-4 | 220 | 2.5 |
| T1-5 | 250 | 2.5 |
| T1-6 | 300 | 8.0 |
| T1-7 | 170 | 0.5 |
| T1-8 | 170 | 10.0 |
| T1-9 | 190 | 15.0 |
| T1-10 | 170 | 0.1 |
| T2-1 | 220 | 1.1 |
| T2-2 | 160 | 2.2 |
| T2-3 | 220 | 0.5 |
| T2-4 | 300 | 5.0 |
| T2-5 | 170 | 0.1 |

Synthesis of Electron Transport Material

In a 500 ml three-necked flask, 26.8 g (100 mmol) of naphthalene-1,4,5,8-tetracarboxylic dianhydride and 250 ml of dimethylacetamide were placed at room temperature under a stream of nitrogen. After heating to 120° C., 11.6 g (100 mmol) of 4-heptylamine was added dropwise thereto with stirring. After completion of the addition, the resultant was stirred for 3 hours. To the resulting solution, a mixture of 9.2 g (100 mmol) of 2-amino-1,3-propanediol and 50 ml of dimethylacetamide were added dropwise with stirring. After completion of the addition, the resultant was heated to reflux for 6 hours. After completion of the reaction, the container was cooled and condensed under vacuum. Ethyl acetate was added to the residue, and the resultant was then filtered. The filtrate was purified by silica gel column chromatography. The collected product was recrystallized from ethyl acetate/hexane to obtain 10.5 g of an electron transport material represented by formula (A1-1). This compound was analyzed by matrix-assisted laser desorption/ionization time-of-flight mass spectrometry (MALDI-TOF MS) and found to have a peak top value of 438.

Production of Electrophotographic Photosensitive Member

Example 1

An aluminum cylinder (JIS-A3003, aluminum alloy) having a length of 260.5 mm and a diameter of 30 mm was used as a support (conductive support).

Next, 100 parts of the niobium-doped titanium oxide particles (T1-1), 80 parts of a phenol resin (trade name: PLYOPHEN J-325, manufactured by DIC Corporation, resin solids content: 60 mass %) serving as a resin, and 60 parts of 1-methoxy-2-propanol were placed in a sand mill with 200 parts of glass beads 0.8 mm in diameter and subjected to a dispersion treatment under the conditions of a rotation speed of 1500 rpm, a dispersion treatment time of 4 hours, and a dispersion temperature of 23° C.±3° C., thereby preparing a dispersion. The glass beads were removed from the dispersion with a mesh (with 150 μm openings).

To the dispersion from which the glass beads were removed, 0.015 parts of a silicone oil (trade name: SH28 PAINT ADDITIVE, manufactured by Dow Corning Toray Co., Ltd.) serving as a leveling agent and 15 parts of silicone resin particles (trade name: TOSPEARL 120, manufactured by Momentive Performance Materials Inc., average primary particle size: 2 μm, density: 1.3 g/cm$^2$) were added. The silicone oil was added to the dispersion such that the amount of silicone oil was 0.01 mass % based on the total mass of the metal oxide particles and the binder resin in the dispersion. The resultant was stirred to prepare a conductive layer coating liquid. The conductive layer coating liquid was applied to a support by dip coating to form a wet coating. The wet coating was dried and thermally cured at 150° C. for 30 minutes to thereby form a conductive layer having a thickness of 30 μm. The silicone resin particles used were TOSPEARL 120 (average particle size: 2 μm) manufactured by Momentive Performance Materials Japan LLC. The silicone oil used was SH28PA manufactured by Dow Corning Toray Co., Ltd.

Next, 3.11 parts of an exemplary compound (A1-1) shown in Table 1 and serving as an electron transport material, 0.40 parts of a styrene-acrylic resin (trade name: UC-3920, manufactured by Toagosei Co., Ltd.) serving as a resin, and 6.49 parts of a blocked isocyanate compound (trade name: SBB-70P, manufactured by Asahi Kasei Corporation) serving as an isocyanate compound were dissolved in a mixed solvent of 48 parts of 1-butanol and 24 parts of acetone. To the solution, 1.8 parts of a silica slurry (product name: IPA-ST-UP, manufactured by Nissan Chemical Industries, Ltd., solids content: 15 mass %, viscosity: 9 mPa·s) dispersed in isopropyl alcohol was added, and the resultant was stirred for 1 hour. The resultant was then filtered under pressure through a Teflon (registered trademark) filter (product name: PF020) manufactured by ADVANTEC. The resulting undercoat layer coating liquid was applied to the conductive layer by dip coating, and the resulting wet coating was heated at 170° C. for 40 minutes and cured (polymerized) to form an undercoat layer having a thickness of 0.7 μm.

Next, hydroxygallium phthalocyanine crystals (charge generation materials) in crystal form having intense peaks at Bragg angles (2θ±0.2°) of 7.5°, 9.9°, 12.5°, 16.3°, 18.6°, 25.1°, and 28.3° in CuKα characteristic X-ray diffraction were provided. Ten parts of the hydroxygallium phthalocyanine crystals, 5 parts of a polyvinyl butyral resin (trade name: S-LEC BX-1, manufactured by Sekisui Chemical Co., Ltd.), and 250 parts of cyclohexanone were placed in a sand mill with glass beads 1 mm in diameter and subjected to a dispersion treatment for 2 hours. Next, 250 parts of ethyl acetate was added to the resulting dispersion to prepare a charge generation layer coating liquid. The charge generation layer coating liquid was applied to the undercoat layer by dip coating to form a wet coating, and the wet coating was dried at 95° C. for 10 minutes to form a charge generation layer having a thickness of 0.15 μm.

Next, 6 parts of an amine compound (charge transport material) represented by formula (2) below, 2 parts of an amine compound (charge transport material) represented by formula (3) below, and 10 parts of a polyester resin having structural units represented by formulae (4) and (5) below at a ratio of 5/5 and having a weight-average molecular weight (Mw) of 100,000 were dissolved in a mixed solvent of 40 parts of dimethoxymethane and 60 parts of chlorobenzene to prepare a charge transport layer coating liquid.

(2)

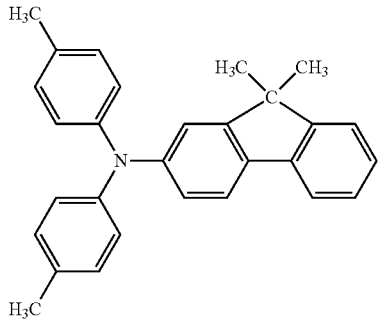

-continued (3)

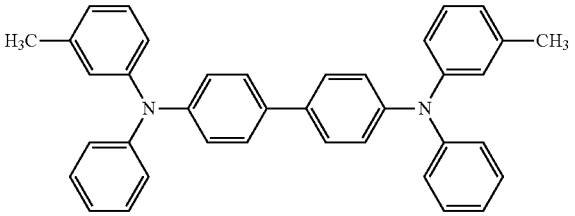

(4)

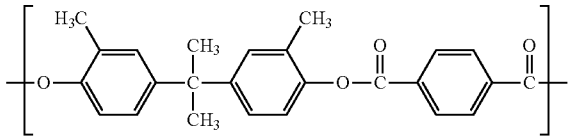

(5)

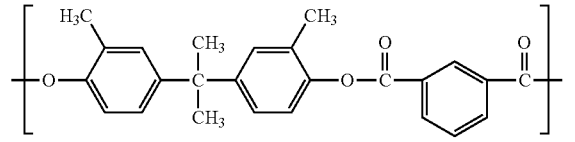

The charge transport layer coating liquid was applied to the charge generation layer by dip coating, and the resulting wet coating was dried at 120° C. for 40 minutes to form a charge transport layer having a thickness of 23 μm.

In this manner, an electrophotographic photosensitive member including a support, a conductive layer, an undercoat layer, a charge generation layer, and a charge transport layer disposed in this order was produced.

Examples 2 to 34

Electrophotographic photosensitive members were produced in the same manner as in Example 1 except that the types and amounts of niobium-doped titanium oxide particles and conductive layer resin mixed in the conductive layer coating liquid and the types and amounts of electron transport material, undercoat layer resin, and crosslinking agent mixed in the undercoat layer coating liquid were changed as shown in Table 2. Evaluations were conducted in the same manner. The results are shown in Table 2.

TABLE 2

Conditions for producing electrophotographic photosensitive members

| Example | Conductive layer | | | Undercoat layer | | | | | |
|---|---|---|---|---|---|---|---|---|---|
| | Conductive particles | | Resin | Electron transport material | | Resin | | Crosslinking agent | |
| No. | Type | Content (vol %) | Type (and ratio) | Type | Amount | Type | Amount | Type | Amount |
| Example 1 | T1-1 | 35 | compound 1 | A1-1 | 3.11 | compound 9 | 0.40 | compound 5 | 6.49 |
| Example 2 | T1-1 | 35 | compound 1 | A1-1 | 3.13 | compound 8/compound 9 | 0.22/0.22 | compound 5 | 6.43 |
| Example 3 | T1-3 | 35 | compound 1 | A1-1 | 3.13 | compound 8/compound 9 | 0.22/0.22 | compound 5 | 6.43 |
| Example 4 | T1-2 | 35 | compound 4/compound 7 (50/50) | A1-1 | 3.13 | compound 8/compound 9 | 0.22/0.22 | compound 5 | 6.43 |
| Example 5 | T1-2 | 35 | compound 4/compound 7 (50/50) | A1-1 | 3.13 | compound 8/compound 9 | 0.22/0.22 | compound 5 | 6.43 |

TABLE 2-continued

| Conditions for producing electrophotographic photosensitive members | | | | | | | | | |
|---|---|---|---|---|---|---|---|---|---|
| | Conductive layer | | | Undercoat layer | | | | | |
| | Conductive particles | | | Electron transport material | | Resin | | Crosslinking agent | |
| Example No. | Type | Content (vol %) | Resin Type (and ratio) | Type | Amount | Type | Amount | Type | Amount |
| Example 6 | T1-3 | 35 | compound 1 | A1-2 | 3.11 | compound 9 | 0.40 | compound 5 | 6.49 |
| Example 7 | T1-3 | 35 | compound 1 | A1-2 | 3.11 | compound 9 | 0.40 | compound 5 | 6.49 |
| Example 8 | T1-3 | 35 | compound 1 | A1-2 | 3.11 | compound 9 | 0.40 | compound 5 | 6.49 |
| Example 9 | T1-3 | 35 | compound 1 | A1-2 | 3.11 | compound 9 | 0.40 | compound 5 | 6.49 |
| Example 10 | T1-1 | 45 | compound 1 | A1-1 | 3.13 | compound 8/compound 9 | 0.22/0.22 | compound 5 | 6.43 |
| Example 11 | T1-1 | 35 | compound 1 | A1-1 | 3.13 | compound 8/compound 9 | 0.22/0.22 | compound 5 | 6.43 |
| Example 12 | T1-1 | 50 | compound 1 | A1-1 | 3.13 | compound 8/compound 9 | 0.22/0.22 | compound 5 | 6.43 |
| Example 13 | T1-1 | 20 | compound 1 | A1-1 | 3.13 | compound 8/compound 9 | 0.22/0.22 | compound 5 | 6.43 |
| Example 14 | T2-1 | 35 | compound 1 | A1-1 | 3.13 | compound 8/compound 9 | 0.22/0.22 | compound 5 | 6.43 |
| Example 15 | T2-3 | 35 | compound 1 | A1-1 | 3.13 | compound 8/compound 9 | 0.22/0.22 | compound 5 | 6.43 |
| Example 16 | T2-5 | 35 | compound 1 | A1-1 | 3.13 | compound 8/compound 9 | 0.22/0.22 | compound 5 | 6.43 |
| Example 17 | T1-1 | 35 | compound 2 | A1-2 | 3.11 | compound 9 | 0.40 | compound 5 | 6.49 |
| Example 18 | T1-1 | 35 | compound 3 | A1-2 | 3.11 | compound 9 | 0.40 | compound 5 | 6.49 |
| Example 19 | T1-1 | 36 | compound 15 | A1-2 | 3.11 | compound 9 | 0.40 | compound 5 | 6.49 |
| Example 20 | T1-1 | 35 | compound 2/compound 9 (80/20) | A1-2 | 3.11 | compound 9 | 0.40 | compound 5 | 6.49 |
| Example 21 | T1-1 | 35 | compound 2/compound 12 (80/20) | A1-2 | 3.11 | compound 9 | 0.40 | compound 5 | 6.49 |
| Example 22 | T1-1 | 35 | compound 1 | A1-1 | 3.06 | compound 10 | 0.28 | compound 5 | 6.66 |
| Example 23 | T1-1 | 35 | compound 1 | A1-1 | 3.09 | compound 8/compound 10 | 0.18/0.18 | compound 5 | 6.55 |
| Example 24 | T1-1 | 35 | compound 1 | A1-1 | 3.20 | compound 11 | 0.20 | compound 5 | 6.60 |
| Example 25 | T1-1 | 35 | compound 1 | A1-1 | 3.48 | compound 8/compound 9 | 0.08/0.08 | compound 5 | 6.36 |
| Example 26 | T1-1 | 35 | compound 1 | A1-1 | 3.07 | compound 9 | 0.98 | compound 5 | 5.95 |
| Example 27 | T1-1 | 35 | compound 1 | A1-1 | 3.41 | compound 8/compound 9 | 0.05/0.05 | compound 5 | 6.49 |
| Example 28 | T1-1 | 35 | compound 1 | A1-1 | 3.11 | compound 9 | 0.35 | compound 6 | 6.54 |
| Example 29 | T1-1 | 35 | compound 1 | A1-1 | 3.12 | compound 8/compound 9 | 0.20/0.20 | compound 6 | 6.48 |
| Example 30 | T1-1 | 35 | compound 1 | A1-1 | 3.07 | compound 10 | 0.24 | compound 6 | 6.69 |
| Example 31 | T1-1 | 35 | compound 1 | A1-3 | 3.13 | compound 8/compound 9 | 0.22/0.22 | compound 5 | 6.43 |
| Example 32 | T1-1 | 35 | compound 1 | A1-6 | 3.11 | compound 9 | 0.40 | compound 5 | 6.49 |
| Example 33 | T1-1 | 35 | compound 1 | A8-1 | 3.25 | compound 9 | 0.82 | compound 5 | 5.93 |
| Example 34 | T1-1 | 35 | compound 1 | A11-1 | 3.36 | compound 9 | 1.16 | compound 5 | 5.48 |

In Table 2, compound 1 is a phenol resin (trade name: PLYOPHEN J-325, manufactured by DIC Corporation, resin solids content: 60 mass %), compound 2 is an epoxy-modified phenol resin (trade name: PHENOLITE 5592, manufactured by DIC Corporation, resin solids content: 55 mass %), compound 3 is a cresol-modified phenol resin (trade name: PHENOLITE TD-447, manufactured by DIC Corporation, resin solids content: 60 mass %), compound 4 is a blocked isocyanate resin (trade name: TPA-B80E, manufactured by Asahi Kasei Corporation, resin solids content: 80 mass %), compound 5 is a blocked isocyanate compound (trade name: SBB-70P, manufactured by Asahi Kasei Corporation, resin solids content: 70 mass %), compound 6 is a blocked isocyanate compound (trade name: SBN-70D, manufactured by Asahi Kasei Corporation, resin solids content: 70 mass %), compound 7 is a polyvinyl butyral resin (trade name: BM-1, manufactured by Sekisui Chemical Co., Ltd.), compound 8 is a polyvinyl acetal resin (trade name: KS-5Z, manufactured by Sekisui Chemical Co., Ltd.), compound 9 is a styrene-acrylic resin (trade name: UC-3920, manufactured by Toagosei Co., Ltd.), compound 10 is a styrene-maleic acid resin (trade name: SMA1000, manufactured by Cray Valley HSC), compound 11 is a carboxyl-modified olefin resin (trade name: SG-2000, manufactured by Namariichi Co., Ltd.), compound 12 is a polyester resin (trade name: OD-X-688, manufactured by DIC Corporation), compound 13 is an alkyd resin (trade name: BECKOLITE M-6401-50, manufactured by Dainippon Ink and Chemicals, Incorporated, resin solids content: 50 mass %), compound 14 is a melamine resin (trade name: SUPER BECKAMINE G-821-60, manufactured by Dainippon Ink and Chemicals, Incorporated, resin solids content: 60 mass %), compound 15 is an alkyl-modified phenol resin (trade name: PHENOLITE TD-2495, manufactured by DIC Corporation, resin solids content: 60 mass %), and A8-1 and A11-1 are compounds represented by the following formulae.

(A8-1)

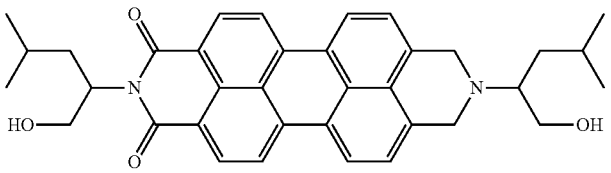

-continued (A11-1)

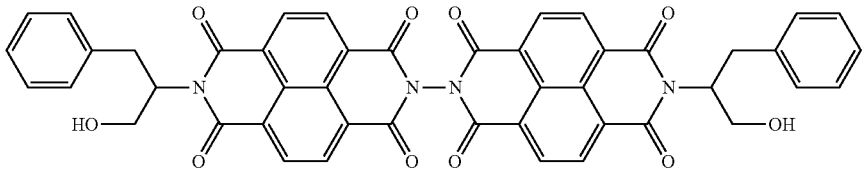

Comparative Example 1

An electrophotographic photosensitive member was produced in the same manner as in Example 1 except that a conductive layer coating liquid and an undercoat layer coating liquid were prepared as described below.

Conductive Layer Coating Liquid

Two hundred fourteen parts of titanium oxide ($TiO_2$) particles coated with oxygen-deficient tin oxide ($SnO_2$) and serving as metal oxide particles, 132 parts of a phenol resin (trade name: PLYOPHEN J-325, manufactured by DIC Corporation, resin solids content: 60 mass %) serving as a binder resin, and 98 parts of 1-methoxy-2-propanol were dispersed for 4.5 hours in a sand mill apparatus with glass beads 0.8 mm in diameter. Silicone resin particles were added to the dispersion such that the amount of the silicone resin particles were 10 mass % based on the total mass of the metal oxide particles and the binder resin in the dispersion from which the glass beads were removed. In addition, a silicone oil was added to the dispersion such that the amount of silicone oil was 0.01 mass % based on the total mass of the metal oxide particles and the binder resin in the dispersion. The resultant was stirred to prepare a conductive layer coating liquid.

Undercoat Layer Coating Liquid

Four parts of a compound represented by formula (6) below, 0.54 parts of a polyvinyl acetal resin (trade name: KS-5Z, manufactured by Sekisui Chemical Co., Ltd.), 7.8 parts of a blocked isocyanate compound (trade name: SBN-70D, manufactured by Asahi Kasei Corporation), and 0.08 parts of zinc(II) hexanoate (trade name: zinc(II) hexanoate, manufactured by Mitsuwa Chemicals Co., Ltd.) were dissolved in a mixed solvent of 60 parts of dimethylacetamide and 60 parts of methyl ethyl ketone to prepare an undercoat layer coating liquid.

(6)

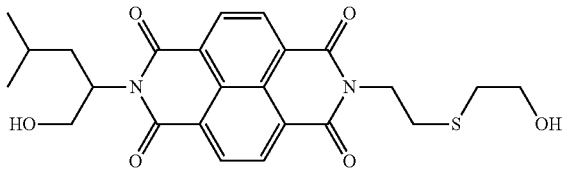

Comparative Example 2

An electrophotographic photosensitive member was produced in the same manner as in Comparative Example 1 except that an undercoat layer coating liquid was prepared as described below. Evaluations were conducted in the same manner. The results are shown in Table 6.

Undercoat Layer Coating Liquid

Eight parts of a compound represented by formula (7) below, 3.5 parts of a compound represented by formula (8) below, 3.4 parts of a styrene-acrylic resin (trade name: UC-3920, manufactured by Toagosei Co., Ltd.), and 0.1 parts of dodecylbenzenesulfonic acid serving as a catalyst were dissolved in a mixed solvent of 100 parts of dimethylacetamide and 100 parts of methyl ethyl ketone to prepare an undercoat layer coating liquid.

(7)

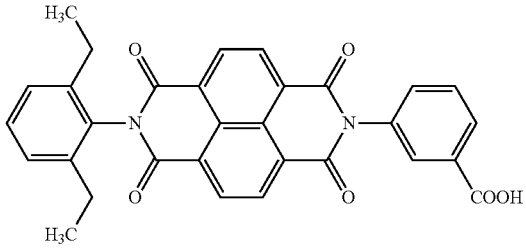

(8)

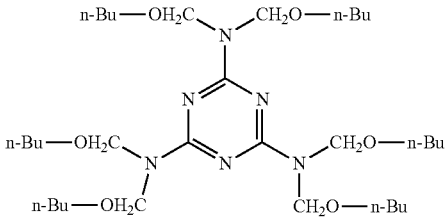

Comparative Example 3

An electrophotographic photosensitive member was produced in the same manner as in Example 1 except that an undercoat layer coating liquid was prepared as described below. Evaluations were conducted in the same manner. The results are shown in Table 2.

Undercoat Layer Coating Liquid

Eight parts of a compound represented by formula (9) below, 2 parts of a polyvinyl acetal resin (trade name: KS-5Z, manufactured by Sekisui Chemical Co., Ltd.), 10 parts of a blocked isocyanate compound (trade name: SBN-70D, manufactured by Asahi Kasei Corporation), and 0.1 parts of zinc(II) hexanoate (trade name: zinc(II) hexanoate) were dissolved in a mixed solvent of 100 parts of dimethylacetamide and 100 parts of methyl ethyl ketone to prepare an undercoat layer coating liquid.

(9)

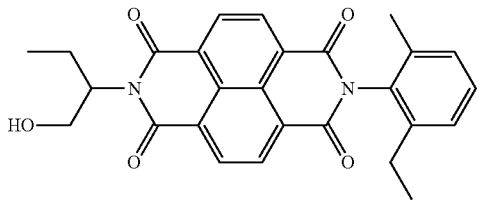

Comparative Example 4

An electrophotographic photosensitive member was produced in the same manner as in Comparative Example 3 except that a conductive layer coating liquid was prepared as described below. Evaluations were conducted in the same manner. The results are shown in Table 2.

Conductive Layer Coating Liquid

Eighty parts of titanium oxide particles (trade name: TTO-55N) serving as metal oxide particles, 28 parts of an alkyd resin (trade name: BECKOLITE M-6401-50, solids content: 50 wt %, manufactured by Dainippon Ink and Chemicals, Incorporated), 10 parts of a melamine resin (trade name: SUPER BECKAMINE G-821-60, solids content: 60 wt %, manufactured by Dainippon Ink and Chemicals, Incorporated), and 50 parts of 2-butanone were mixed together. The mixture was dispersed for 3 hours in a sand mill apparatus with glass beads 1 mm in diameter to obtain a conductive layer coating liquid.

Evaluations

Evaluation of Ghost

The electrophotographic photosensitive members produced above were each mounted on a CANON laser beam printer (trade name: LBP-2510) to which some modifications were made, and process conditions were set as described below. Subsequently, surface potentials (electric potential changes) were evaluated. The modifications made were as follows: process speed, 200 mm/s; dark-area potential, −700 V; light quantity of exposure light (image exposure light), variable. Specifically, the evaluation was conducted as follows.

In an environment at a temperature of 23° C. and a humidity of 50% RH, the electrophotographic photosensitive member produced was mounted on a process cartridge for cyan of the laser beam printer, the process cartridge being modified so that the stress applied to the electrophotographic photosensitive member by a cleaning blade is increased. The process cartridge with the electrophotographic photosensitive member was mounted on a cyan process cartridge station, and images were output. Specifically, one solid white image, five images for ghost evaluation, one solid black image, and five images for ghost evaluation were continuously output in this order.

Figure 2:
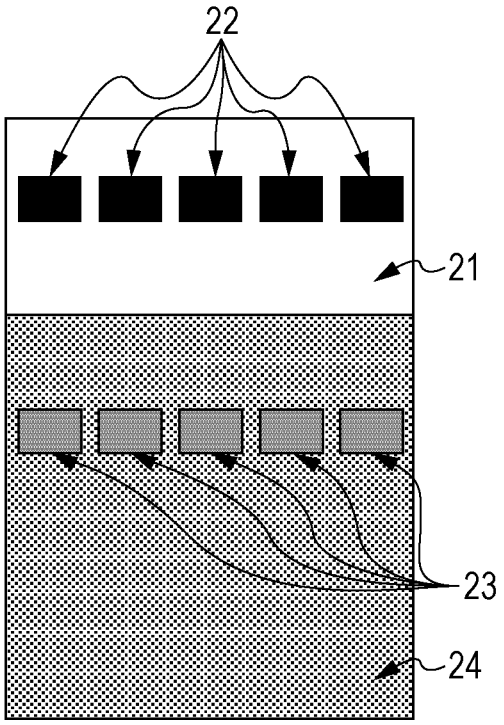
FIG. 2 is a diagram for explaining printing for ghost evaluation used in a ghost image evaluation.
Figure 3:
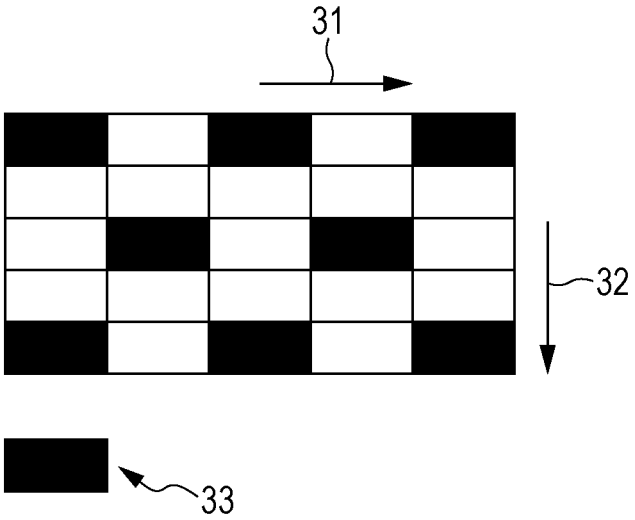
FIG. 3 is a diagram for explaining a similar knight jump pattern image.

As illustrated in FIG. 2, the images for ghost evaluation are each output as follows: quadrangular "solid images 22" are output on a "white image 21" in a leading end portion, and then a "halftone image with a similar knight jump pattern" illustrated in FIG. 3 is formed. In FIG. 3, reference numeral 31 indicates the main scanning direction, reference numeral 32 indicates the sub-scanning direction, and reference numeral 33 indicates one dot. In FIG. 2, "ghost 23" portions are portions where ghosts due to the "solid images" may appear.

The evaluation of positive ghosts was performed by measuring the difference in image density between the halftone image with a similar knight jump pattern 24 and the ghost portions. The difference in image density was measured with a spectrodensitometer (trade name: X-Rite 504/508, manufactured by X-Rite Inc.) at 10 points in one image for ghost evaluation. This operation was performed on all the 10 images for ghost evaluation, and the average of a total of 100 points was calculated.

A difference (initial) in Macbeth density at the time of the initial image output was determined. Next, the difference (variation) between a difference in Macbeth density after the output of 5,000 images and the difference in Macbeth density at the time of the initial image output was calculated to determine a variation in difference in Macbeth density. The evaluation results of the positive ghosts are shown in Table 4. The smaller the difference in Macbeth density is, the more the positive ghosts are reduced. The smaller the difference between the difference in Macbeth density after the output of 5,000 images and the difference in Macbeth density at the time of the initial image output, the smaller the variation in positive ghost. The evaluation criteria are as described below. Levels D and E are determined to be insufficient in the effect of the present disclosure.

Level A: No ghosts are observed in any of the images for ghost evaluation.

Level B: Faint ghosts are observed in some of the images for ghost evaluation.

Level C: Faint ghosts are observed in all of the images for ghost evaluation.

Level D: Clear ghosts are observed in some of the images for ghost evaluation.

Level E: Clear ghosts are observed in all of the images for ghost evaluation.

The evaluation results are shown in Table 3.

Evaluation of External Stress

At 10 points on each of the electrophotographic photosensitive members produced above, the area of film breakage (peeling) under a load was measured using a microhardness meter under the following conditions. The average value was calculated to determine the "resistance to external stress". Smaller areas indicate higher resistances. The microhardness meter used was a FISCHERSCOPE HM2000 (manufactured by Fischer Instruments), and the measurement was performed in a normal-temperature and normal-humidity environment at a temperature of 23° C. and relative humidity of 50%. The evaluation results are shown in Table 3.

Conditions

Indenter: pyramidal diamond indenter (Vickers indenter, the angle between opposite faces is 136°)

Maximum indentation load: 2,000 mN

Time period during which load is applied: 0 seconds

TABLE 3

| Evaluation results | | | | | |
|---|---|---|---|---|---|
| | Evaluation results | | | | |
| | Evaluation of ghost | | | Evaluation of external stress | |
| Example No. | Initial | Variation | Image | Initial | After durability test |
| Example 1 | 0.024 | 0.005 | A | 6.5 | 8.3 |
| Example 2 | 0.025 | 0.006 | A | 6.3 | 8.8 |
| Example 3 | 0.027 | 0.006 | A | 5.8 | 9.1 |
| Example 4 | 0.025 | 0.007 | A | 7.5 | 9.6 |
| Example 5 | 0.025 | 0.004 | A | 6.2 | 8.7 |
| Example 6 | 0.023 | 0.003 | A | 7.1 | 8.9 |

TABLE 3-continued

| Evaluation results | | | | | |
|---|---|---|---|---|---|
| | Evaluation results | | | | |
| | Evaluation of ghost | | | Evaluation of external stress | |
| Example No. | Initial | Variation | Image | Initial | After durability test |
| Example 7 | 0.029 | 0.006 | A | 6.5 | 9.3 |
| Example 8 | 0.030 | 0.008 | A | 7.6 | 9.8 |
| Example 9 | 0.036 | 0.015 | B | 9.4 | 10.6 |
| Example 10 | 0.029 | 0.007 | A | 6.7 | 8.5 |
| Example 11 | 0.020 | 0.002 | A | 6.6 | 8.3 |
| Example 12 | 0.038 | 0.017 | B | 8.8 | 9.4 |
| Example 13 | 0.033 | 0.009 | B | 8.3 | 10.3 |
| Example 14 | 0.027 | 0.015 | B | 7.1 | 9.3 |
| Example 15 | 0.022 | 0.015 | B | 8.5 | 10.5 |
| Example 16 | 0.020 | 0.016 | B | 8.9 | 10.8 |
| Example 17 | 0.022 | 0.003 | A | 5.2 | 5.5 |
| Example 18 | 0.024 | 0.006 | A | 5.5 | 5.6 |
| Example 19 | 0.029 | 0.008 | A | 5.3 | 5.9 |
| Example 20 | 0.024 | 0.006 | A | 5.4 | 5.7 |
| Example 21 | 0.023 | 0.005 | A | 5.1 | 5.8 |
| Example 22 | 0.025 | 0.008 | A | 7.7 | 8.1 |
| Example 23 | 0.033 | 0.005 | A | 6.5 | 8.6 |
| Example 24 | 0.035 | 0.014 | A | 10.1 | 10.8 |
| Example 25 | 0.022 | 0.007 | A | 7.3 | 8.8 |
| Example 26 | 0.038 | 0.015 | B | 8.9 | 10.8 |
| Example 27 | 0.023 | 0.005 | B | 12.1 | 14.3 |
| Example 28 | 0.026 | 0.004 | A | 13.5 | 14.8 |
| Example 29 | 0.029 | 0.008 | A | 14.2 | 14.5 |
| Example 30 | 0.028 | 0.006 | A | 13.6 | 14.1 |
| Example 31 | 0.023 | 0.007 | A | 7.2 | 8.9 |
| Example 32 | 0.025 | 0.007 | A | 6.4 | 9.3 |
| Example 33 | 0.026 | 0.005 | A | 7.3 | 8.3 |
| Example 34 | 0.023 | 0.011 | B | 8.7 | 10.3 |
| Comparative Example 1 | 0.031 | 0.040 | B | 31.5 | 66.2 |
| Comparative Example 2 | 0.033 | 0.053 | C | 33.2 | 70.5 |
| Comparative Example 3 | 0.024 | 0.011 | A | 30.3 | 68.5 |
| Comparative Example 4 | 0.047 | 0.048 | D | 34.1 | 69.3 |

As has been discussed above with reference to the embodiments and examples, the present disclosure provides an electrophotographic photosensitive member that is less likely to experience the occurrence of ghosts through repeated use, has improved adhesion between a conductive layer and an undercoat layer, and has improved resistance to external stress, a process cartridge including the electrophotographic photosensitive member, and an electrophotographic apparatus including the electrophotographic photosensitive member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2018-143283, filed Jul. 31, 2018, which is hereby incorporated by reference herein in its entirety.

What is claimed is:

1. An electrophotographic photosensitive member comprising, in sequence:

a support;

a conductive layer;

an undercoat layer;

a charge generation layer; and a charge transport layer, wherein the conductive layer is a cured film containing titanium oxide particles doped with niobium, the titanium oxide particle being obtained by coating anatase-type titanium oxide particles serving as cores with titanium oxide doped with niobium, the conductive layer contains a resin having at least one member selected from the group consisting of a hydroxy group, and a carboxyl group, and the undercoat layer contains a cured product of a composition that contains an electron transport material having a polymerizable functional group and a resin functionalized with a carboxylic acid derivative, the resin having a structure represented by formula (B1):

(B1)

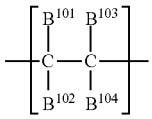

where, in the formula (B1), $B^{101}$ to $B^{104}$ are each independently at least one member selected from the group consisting of a hydrogen atom, a methyl group, and a substituted or unsubstituted phenyl group, and at least one of $B^{101}$ to $B^{104}$ is a substituted or unsubstituted phenyl group, and a structure represented by formula (B2-1) or (B2-2):

(B2-2)

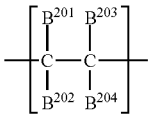

where, in the formula (B2-1), $B^{201}$ to $B^{204}$ are each independently at least one member selected from the group consisting of a hydrogen atom, a methyl group, a carboxyl group, and an alkoxycarbonyl group, and at least one of $B^{201}$ to $B^{204}$ is a carboxyl group or an alkoxycarbonyl group;

(B2-2)

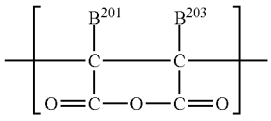

where, in the formula (B2-2), $B^{201}$ and $B^{203}$ are each independently a hydrogen atom or a methyl group.

2. The electrophotographic photosensitive member according to claim 1, wherein in the conductive layer, a content of the titanium oxide particles doped with niobium is 20 vol % or more and 50 vol % or less based on a total mass of the conductive layer, and a doping amount of niobium is 0.5 mass % or more and 10.0 mass % or less based on a mass of the doped titanium oxide particles.

3. The electrophotographic photosensitive member according to claim 1, wherein the composition in the undercoat layer further contains a biuret-type isocyanate compound serving as a crosslinking agent.

4. The electrophotographic photosensitive member according to claim 1, wherein the electron transport material having a polymerizable functional group in the undercoat layer is a compound represented by formula (A1):

(A1)

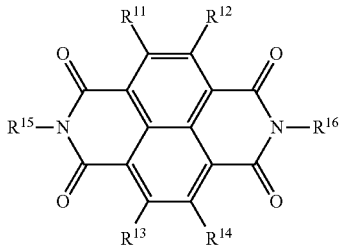

where $R^{15}$ and $R^{16}$ are each independently a substituted or unsubstituted alkyl group having 2 to 6 carbon atoms, a group derived from a substituted or unsubstituted alkyl group having 3 to 6 main-chain carbon atoms by replacing at least one $CH_2$ in the main chain with an oxygen atom, a group derived from a substituted or unsubstituted alkyl group having 3 to 6 main-chain carbon atoms by replacing at least one $CH_2$ in the main chain with $NR^{124}$, a group derived from a substituted or unsubstituted alkyl group having 3 to 6 main-chain carbon atoms by replacing at least one $C_2H_4$ in the main chain with COO, or a substituted aryl group, $R^{124}$ represents a hydrogen atom or an alkyl group having 1 to 4 carbon atoms, the substituents of the substituted alkyl group, the group derived from a substituted alkyl group by replacing at least one $CH_2$ in the main chain with an oxygen atom, the group derived from a substituted alkyl group by replacing at least one $CH_2$ in the main chain with $NR^{124}$, and the group derived from a substituted alkyl group by replacing at least one $C_2H_4$ in the main chain with COO are each a group selected from the group consisting of an alkyl group having 1 to 5 carbon atoms, a benzyl group, an alkoxycarbonyl group, a phenyl group, a hydroxy group, a thiol group, an amino group, and a carboxyl group, the substituent of the substituted aryl group is a group selected from the group consisting of a halogen atom, a cyano group, a nitro group, a methyl group, an ethyl group, an isopropyl group, a n-propyl group, a n-butyl group, an acyl group, an alkoxy group, an alkoxycarbonyl group, a hydroxy group, a thiol group, an amino group, and a carboxyl group and includes at least one hydroxy group or carboxyl group, and $R^{11}$ to $R^{14}$ each independently represent a hydrogen atom, a halogen atom, a cyano group, a nitro group, a substituted or unsubstituted alkyl group having 1 to 6 carbon atoms, or a substituted or unsubstituted aryl group.

5. The electrophotographic photosensitive member according to claim 1, wherein the conductive layer is a cured film containing at least one phenol resin selected from the group consisting of cresol-modified phenol resins, epoxy-modified phenol resins, and alkyl-modified phenol resins.

6. A process cartridge that integrally supports an electrophotographic photosensitive member and at least one device selected from the group consisting of a charging device, a developing device, and a cleaning device and that is attachable to and detachable from a main body of an electrophotographic apparatus, wherein the electrophotographic photosensitive member includes, in sequence, a support, a conductive layer, an undercoat layer, a charge generation layer, and a charge transport layer, the conductive layer is a cured film containing titanium oxide particles doped with niobium, the titanium oxide particle being obtained by coating anatase-type titanium oxide particles serving as cores with titanium oxide doped with niobium, the conductive layer contains a resin having at least one member selected from the group consisting of a hydroxy group, and a carboxyl group, and the undercoat layer contains a cured product of a composition that contains an electron transport material having a polymerizable functional group and a resin functionalized with a carboxylic acid derivative, the resin having a structure represented by formula (B1):

(B1)

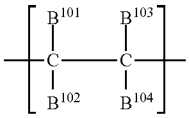

where, in the formula (B1), $B^{101}$ to $B^{104}$ are each independently at least one member selected from the group consisting of a hydrogen atom, a methyl group, and a substituted or unsubstituted phenyl group, and at least one of $B^{101}$ to $B^{104}$ is a substituted or unsubstituted phenyl group, and a structure represented by formula (B2-1) or (B2-2):

(B2-1)

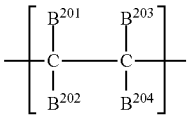

where, in the formula (B2-1), $B^{201}$ to $B^{204}$ are each independently at least one member selected from the group consisting of a hydrogen atom, a methyl group, a carboxyl group, and an alkoxycarbonyl group, and at least one of $B^{201}$ to $B^{204}$ is a carboxyl group or an alkoxycarbonyl group;

(B2-2)

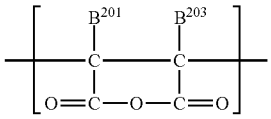

where, in the formula (B2-2), $B^{201}$ and $B^{203}$ are each independently a hydrogen atom or a methyl group.

7. An electrophotographic apparatus comprising:

an electrophotographic photosensitive member;

a charging device;

an exposure device;

a developing device; and a transfer device, wherein the electrophotographic photosensitive member includes, in sequence, a support, a conductive layer, an undercoat layer, a charge generation layer, and a charge transport layer, the conductive layer is a cured film containing titanium oxide particles doped with niobium, the titanium oxide particle being obtained by coating anatase-type titanium oxide particles serving as cores with titanium oxide doped with niobium, the conductive layer contains a resin having at least one member selected from the group consisting of a hydroxy group, and a carboxyl group, and the undercoat layer contains a cured product of a composition that contains an electron transport material having a polymerizable functional group and a resin functionalized with a carboxylic acid derivative, the resin having a structure represented by formula (B1):

(B1)

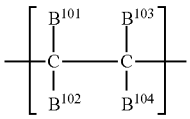

where, in the formula (B1), $B^{101}$ to $B^{104}$ are each independently at least one member selected from the group consisting of a hydrogen atom, a methyl group, and a substituted or unsubstituted phenyl group, and at least one of $B^{101}$ to $B^{104}$ is a substituted or unsubstituted phenyl group, and a structure represented by formula (B2-1) or (B2-2):

(B2-1)

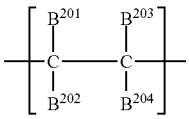

where, in the formula (B2-1), $B^{201}$ to $B^{204}$ are each independently at least one member selected from the group consisting of a hydrogen atom, a methyl group, a carboxyl group, and an alkoxycarbonyl group, and at least one of $B^{201}$ to $B^{204}$ is a carboxyl group or an alkoxycarbonyl group; or (B2-2)

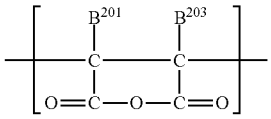

where, in the formula (B2-2), $B^{201}$ and $B^{203}$ are each independently a hydrogen atom or a methyl group.

* * * * *